US010117018B2

(12) United States Patent
Shao et al.

(10) Patent No.: US 10,117,018 B2
(45) Date of Patent: Oct. 30, 2018

(54) SPEAKER MODULE

(71) Applicant: GOERTEK INC., Weifang (CN)

(72) Inventors: Minghui Shao, Weifang (CN); Jianbin Yang, Weifang (CN)

(73) Assignee: GOERTEK INC., Weifang (CN)

( * ) Notice: Subject to any disclaimer, the term of this patent is extended or adjusted under 35 U.S.C. 154(b) by 31 days.

(21) Appl. No.: 15/323,045

(22) PCT Filed: Sep. 9, 2014

(86) PCT No.: PCT/CN2014/086110
§ 371 (c)(1),
(2) Date: Dec. 29, 2016

(87) PCT Pub. No.: WO2016/000312
PCT Pub. Date: Jan. 7, 2016

(65) Prior Publication Data

US 2017/0134848 A1 May 11, 2017

(30) Foreign Application Priority Data

Jun. 30, 2014 (CN) ..... 2014 1 0307356

(51) Int. Cl.

| | |
|---|---|
| ***H04R 7/18*** | (2006.01) |
| ***H04R 9/06*** | (2006.01) |
| ***H04R 1/28*** | (2006.01) |
| ***H04R 7/12*** | (2006.01) |
| ***H04R 9/02*** | (2006.01) |

(52) U.S. Cl.
CPC ..... *H04R 1/2834* (2013.01); *H04R 1/2842* (2013.01); *H04R 1/2857* (2013.01);
(Continued)

(58) Field of Classification Search
CPC ..... H04R 1/2834
See application file for complete search history.

(56) References Cited

U.S. PATENT DOCUMENTS

2002/0148678 A1* 10/2002 Sahyoun ..... H04R 7/20 181/172
2009/0245561 A1* 10/2009 Litovsky ..... H04R 1/2834 381/345

(Continued)

FOREIGN PATENT DOCUMENTS

CN 1906970 A 1/2007
CN 202172481 U 3/2012

(Continued)

OTHER PUBLICATIONS

Office Action from Chinese Patent Office for CN Application No. 201410307356.X, dated Jan. 18, 2017.

(Continued)

*Primary Examiner* — Duc Nguyen
*Assistant Examiner* — Phan Le

(57) ABSTRACT

Disclosed is a speaker module, comprising an active sound source, a passive sound source and a protective frame; the active sound source comprises a vibration system and a magnetic circuit system; the side surface of the protective frame is provided with a sound hole for the active sound source; the passive sound source comprises two passive radiators, and the two passive radiators are arranged in parallel and enclose a cavity; a sound wave at one side of a vibrating diaphragm adjacent to the magnetic circuit system is divided into two parts respectively transmitted to one side of each of the two passive radiators away from the cavity; and a sound wave in the cavity is projected and emitted to the external environment via a sound hole for the passive sound source. The structure improves the bass effect of the speaker module, and improves the acoustic performance of the product.

10 Claims, 3 Drawing Sheets

(52) U.S. Cl.
CPC ..... *H04R 7/127* (2013.01); *H04R 7/18* (2013.01); *H04R 9/025* (2013.01); *H04R 9/06* (2013.01); *H04R 2307/025* (2013.01); *H04R 2499/11* (2013.01)

(56) References Cited

U.S. PATENT DOCUMENTS

| | | | | |
|---|---|---|---|---|
| 2010/0111343 | A1* | 5/2010 | Hsu | H04R 1/2834 381/335 |
| 2010/0316242 | A1* | 12/2010 | Cohen | H02K 41/03 381/337 |
| 2013/0213682 | A1 | 8/2013 | Schlesak et al. | |
| 2015/0358705 | A1* | 12/2015 | Chen | H04R 1/2842 381/386 |

FOREIGN PATENT DOCUMENTS

| | | | |
|---|---|---|---|
| CN | 102572639 | A | 7/2012 |
| CN | 202503632 | U | 10/2012 |
| CN | 103118320 | A | 5/2013 |
| CN | 203225876 | U | 10/2013 |
| CN | 203387671 | U | 1/2014 |
| CN | 204392545 | U | 6/2015 |
| JP | 2009-232040 | A | 10/2009 |
| JP | 2013-102409 | A | 5/2013 |
| KR | 10-0445211 | B1 | 12/2004 |

OTHER PUBLICATIONS

International Search Report for International Patent Application No. PCT/CN2014/086110 dated Sep. 9, 2014.
Office Action from Chinese Patent Office for Chinese Application No. 201410307356.X, dated Jul. 25, 2017.
Office Action from Japanese Patent Office for Japanese Application No. 2017-514756, dated Sep. 21, 2017.
Office Action from Korean Patent Office for Korean Application No. 10-2016-7029346, dated Sep. 29, 2017.
Supplementary Extended European Search Report for EP Application No. 14896879.5 dated Nov. 29, 2017.

* cited by examiner

SPEAKER MODULE

CROSS-REFERENCE TO RELATED APPLICATIONS

The present application is a U.S. National Stage of International Patent Application No. PCT/CN2014/086110 filed Sep. 9, 2014, which claims priority to and the benefit of Chinese Patent Application No. 201410307356.X filed in the Chinese Intellectual Property Office on Jun. 30, 2014, the entire contents of which are incorporated herein by reference.

TECHNICAL FIELD

The present invention relates to the technical field of electroacoustic conversion, more specifically, to a speaker module capable of enhancing bass effect.

BACKGROUND ART

With the social progress and technical development, the volume and thickness of the terminal electronic device are reduced, and correspondingly, the volume of the micro-loudspeaker cooperated therewith becomes smaller and smaller. However, the requirement on the performance of products, especially on the heavy bass effect of sound, is increasingly higher. As for speaker modules with a smaller volume, it is difficult to achieve ideal bass effect due to the limitation on the volume.

The speaker module usually comprises a speaker unit and a plurality of housings provided around the speaker unit. The speaker unit usually comprises a vibration system and a magnetic circuit system. The vibration system comprises a vibrating diaphragm and a voice coil. The magnetic circuit system forms a magnetic gap for accommodating the voice coil. The vibrating diaphragm vibrates under the driving of the voice coil, so as to produce sound which is radiated to outside to be heard. A front acoustic cavity and a rear acoustic cavity separated from each other are formed between the vibrating diaphragm and the housings, the front acoustic cavity is in communication with the sound hole of the speaker module, and the rear acoustic cavity is typically an enclosed structure. The larger the volume of the rear acoustic cavity, the better the bass effect is. However, due to the limited space of the speaker module, it is hard to achieve the desired bass effect.

Thus, it is required to provide a speaker module to solve the above problems.

SUMMARY

In view of the above problems, an objective of the present invention is to provide a speaker module, and the speaker module is capable of fully utilizing the internal space of the speaker module, improving the bass effect, and improving the acoustical performance of the product in the case of a certain size of the speaker module.

In order to solve the above technical problems, the present invention provides a speaker module, comprising an active sound source, a passive sound source, and a protective frame for accommodating and fixing the active sound source and the passive sound source, wherein the active sound source comprises a vibration system and a magnetic circuit system, the vibration system comprises a vibrating diaphragm and a voice coil, and the magnetic circuit system is formed with a magnetic gap for accommodating the voice coil; a front acoustic cavity is formed between an upper side of the vibrating diaphragm and the protective frame, and a rear acoustic cavity is formed between a side of the vibrating diaphragm closer to the magnetic circuit system and the protective frame, wherein the active sound source has a structure emitting sound at a lateral side, and a sound hole for the active sound source is provided at a lateral side of the protective frame, and the sound hole for the active sound source is in communication with the front acoustic cavity; the passive sound source is provided in the rear acoustic cavity and comprises two passive radiators opposite to each other, and the two passive radiators are arranged in parallel, and a cavity is formed between the two passive radiators; a sound wave at the side of the vibrating diaphragm closer to the magnetic circuit system is divided into two parts, which are transmitted to a side of each of the two passive radiators away from the cavity, respectively, and a sound wave in the cavity is pressed and radiated to outside through sound holes for the passive sound source.

In addition, it is preferred that, the sound hole for the active sound source and the sound holes for the passive sound source are isolated from each other, and are located at a same lateral side of the speaker module.

In addition, it is preferred that, the cavity between the two passive radiators is in communication with the sound holes for the passive sound source through acoustic guide channels, and the acoustic guide channels are formed by the protective frame.

In addition, it is preferred that, the protective frame comprises an upper housing, a middle housing and a lower housing, the active sound source is accommodated by the upper housing and the middle housing, and the passive sound source is accommodated by the middle housing and the lower housing; metal sheets are injection-molded at a side of the upper housing facing the vibrating diaphragm, a side of the middle housing facing the passive radiators, and a side of the lower housing facing the passive radiators, respectively.

In addition, it is preferred that, the acoustic guide channels are formed by bonding the middle housing with the lower housing; a bonding rib is provided at a side of the middle housing facing the lower housing, and the acoustic guide channels are formed by bonding the bonding rib with the lower housing.

In addition, it is preferred that, the number of the sound holes for the passive sound source is two, and the two sound holes for the passive sound source are positioned at two sides of the sound hole for the active sound source, respectively; apertures for communicating the cavity with the acoustic guide channels are provided at the middle housing, both the number of the apertures and the number of the acoustic guide channels are two, and the two apertures and the two acoustic guide channels are in communication with the two sound holes for the passive sound source, respectively.

In addition, it is preferred that, steel sheets are injection-molded at portions of outer lateral walls of the acoustic guide channels facing the active sound source, the number of the steel sheets is two, and the two steel sheets and two outer lateral walls of the middle housing are integrally injection-molded, respectively.

In addition, it is preferred that, the two passive radiators have an identical structure, and each of the two passive radiators comprises a vibrating diaphragm body part and mass blocks bonded to the vibrating diaphragm body part; the vibrating diaphragm body part is made of thermoplastic polyurethane material.

In addition, it is preferred that, the mass blocks are bonded at center positions of an upper side and a lower side of the vibrating diaphragm body part, and the mass blocks are made of tungsten steel alloy material.

In addition, it is preferred that, the vibrating diaphragm of the active sound source comprises a dome portion located at a central position thereof and a suspension ring portion located at an edge position thereof, and a position where the suspension ring portion is connected with the housing is lower than a position where the suspension ring portion is connected with the dome portion.

With the above technical solution, compared with the traditional structure, the rear acoustic cavity of the speaker module provided by the present invention is provided with a passive sound source therein, the sound wave inside the cavity between the two passive radiators are radiated to the outside by being pressed by the two passive radiators of the passive sound source, thereby improving the bass effect of the product and improving the acoustic performance of the product.

BRIEF DESCRIPTION OF THE DRAWINGS

By referring to the descriptions in connection with the accompanying drawings and the contents of the claims, and with a full understanding of the present invention, other purposes and results of the present invention will be more clearly and easily understand. In the drawings:

Figure 1:
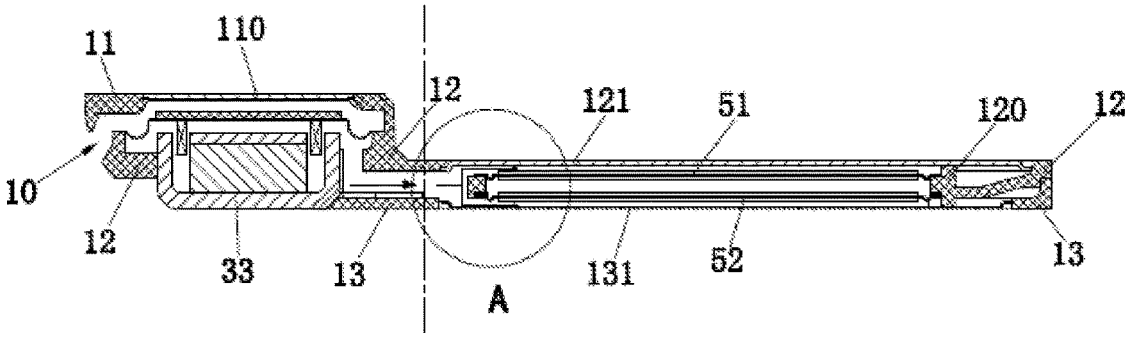
FIG. 1 is a sectional structure diagram of the loudspeaker module according to the present invention.

The reference numerals in the drawings comprise: upper housing 11, metal sheet 110, middle housing 12, supporting pillar 120, metal sheet 121, bonding rib 123, steel sheet 124, lower housing 13, metal sheet 131, sound hole 10 for the active sound source, sound holes 20 for the passive sound source, passive radiator 51, passive radiator 52, apertures 53, vibrating diaphragm body part 510, mass block 511, vibrating diaphragm body part 520, mass block 521, vibrating diaphragm 21, suspension ring portion 211, voice coil 22, pole plate 31, magnet 32, yoke 33, yoke aperture 330.

Same reference numerals in all of the accompanying drawings indicate similar or same features or functions.

DETAILED DESCRIPTION OF EMBODIMENTS

Hereinafter, the present invention will be described in details in connection with the accompanying drawings and particular embodiments.

In the following description, several exemplary embodiments of the present invention are described by way of illustration. There is no doubt that various manners can be utilized to modify the embodiments without departing from the spirit and scope of the present invention, as can be realized by those skilled in the art. Consequently, the accompanying drawings and description are illustrative in essence, but not intended to limit the scope of the present disclosure. In the present description, the same reference numerals refer to the same parts.

The speaker module of the present invention comprises an active sound source and a passive sound source, and the passive sound source is specifically a passive radiator. The active sound source is a part capable of generating sound actively, and comprises a vibration system and a magnetic circuit system, the vibration system comprises a vibrating diaphragm and a voice coil, the voice coil is accommodated by a magnetic gap formed by the magnetic circuit system, the voice coil vibrates up and down in the magnetic gap when powered, and further vibrates the vibrating diaphragm to generate sound. The active sound source is divided into a front acoustic cavity and a rear acoustic cavity by the vibrating diaphragm, the front acoustic cavity is located at the upper side of the vibrating diaphragm, and the front acoustic cavity is in communication with the sound hole for the active sound source so as to radiate the sound generated by the vibrating diaphragm to the outside. The space at the back side of the vibrating diaphragm is the rear acoustic cavity of the active sound source, and the passive sound source is provided in the rear acoustic cavity. The passive sound source of the present invention comprises two parallel and opposite passive radiators, and a cavity is formed between the two passive radiators. The sound wave at one side of the vibrating diaphragm of the active sound source closer to the magnetic circuit system is divided into two parts after radiated from the active sound source, and the two parts respectively transmitted to the sides of the two passive radiators away from the above cavity, and then the two passive radiators press against the cavity to enable the air flow inside the cavity to be radiated to the outside through the sound holes for the passive sound source. In the present invention, by fully using the volume of the rear acoustic cavity, two passive radiators are provided so as to improve the bass effect of the speaker module.

Figure 2:
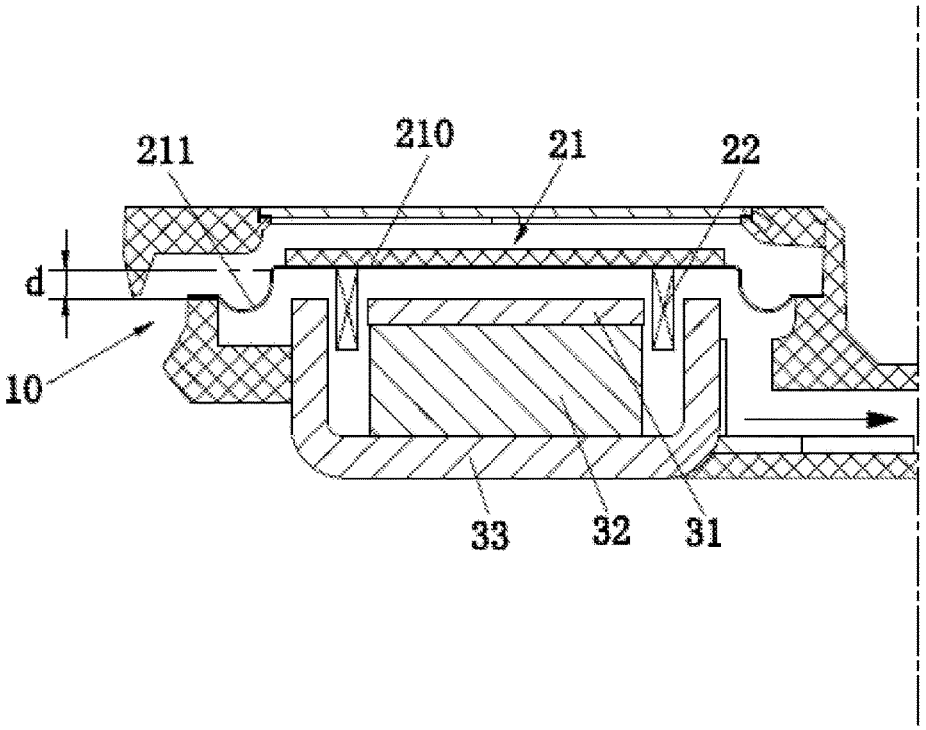
FIG. 2 is a sectional structure diagram of the active sound source according to the present invention.

FIG. 1 is a sectional structure diagram of the loudspeaker module according to the present invention, and FIG. 2 is a sectional structure diagram of the active sound source according to the present invention.

As jointly shown in FIG. 1 and FIG. 2, the speaker module comprises an active sound source at the left side, a passive sound source at the right side, and a protective frame for accommodating the active sound source and the passive sound source. Wherein, the protective frame comprises an upper housing 11 at the upper side (one side adjacent to the vibrating diaphragm), a middle housing 12, and a lower housing 13 at the lower side.

The active sound source is a part capable of generating sound actively, as shown in FIG. 2, the active sound source comprises a vibration system and a magnetic circuit system; wherein, the vibration system comprises a vibrating diaphragm 21 and a voice coil 22 bonded at the lower side of the vibrating diaphragm 21; the magnetic circuit system comprises a pole plate 31, a magnet 32 and a yoke 33 that are sequentially bonded together. In the magnetic circuit system, there is a gap between the outer lateral surfaces of the pole plate 31 as well as the magnet 32 and the lateral wall of the yoke 33, the gap is the magnetic gap, in which the voice coil 22 is accommodated, and the magnetic lines formed by the magnetic circuit system pass through the voice coil 22. Wherein, the voice coil 22 is typically formed by winding conductive metal wires, for example, copper-clad aluminum wires. The voice coil 22 is subjected to Ampere force in the magnetic field formed by the magnetic circuit system when an electric signal is applied to the voice coil 22. As the signal applied to the voice coil 22 is an alternating signal, the magnitude and direction of the Ampere force is changed in accord with the signal. Thus, the voice coil 22 vibrates in the magnetic gap up and down due to the Ampere force to which the voice coil 22 is subjected. As the voice coil 22 and the vibrating diaphragm 21 are fixedly and integrally bonded, the vibrating diaphragm 21 will vibrate with the voice coil 22, thereby generating sound.

The vibrating diaphragm 21 comprises a tabulate dome portion 210 located at the central position thereof, and a suspension ring portion 211 located at the edge of the dome portion. A rigid composite layer is typically bonded to the dome portion 210, as shown in FIG. 2, and has good rigidity and lighter weight. The addition of composite layer may be beneficial to improvement of the high frequency properties of the vibrating diaphragm 21, and prevention of the vibrating diaphragm 21 from split vibration in high band. The suspension ring portion 211 is connected to the dome portion 210 and has an arcuate and flexible structure which enables the vibrating diaphragm 21 to vibrate up and down but not drags the vibrating diaphragm 21 excessively. The suspension ring portion 211 in the present embodiment has a concave structure, that is, a structure formed concave towards one side closer to the magnetic circuit system. The concave structure of the suspension ring portion 211 is specifically provided in accord with the specific structure of the loudspeaker module to avoid collision to the upper housing 11 so as to fully use the inner space of the module, thereby facilitating reducing the thickness of the active sound source, and increasing the overall size of the active sound source.

The active sound source has a structure emitting sound at the lateral side, and a sound hole 10 for the active sound source is formed between the upper housing 11 and the middle housing 12. As shown in FIG. 1 and FIG. 2, the sound hole 10 is located at the lateral surface of the protective frame, and specifically, is formed by bonding the upper housing 11 and the middle housing 12. There is a height difference between two ends of the suspension ring portion 211 provided by the present invention in order to enlarge the size of the sound hole 10 and radiate the air flow generated by the active sound source smoothly. That is, there is a height difference d between the position where the suspension ring portion 211 is connected to the middle housing 12, and the position where the suspension ring portion 211 is connected to the dome portion 210. Specifically, the position where the suspension ring portion 211 is bonded to the middle housing 11 is lower, as shown in FIG. 2, and accordingly, the position of the side of middle housing 12 closer to the upper housing 11 is lower. The distance between the upper housing 11 and the middle housing 12 is increased at one side of the vibrating diaphragm 21, thereby increasing the height difference of the sound hole 10, and increasing the area for radiating sound.

The upper housing 11 of the protective frame is provided at the upper side of the vibrating diaphragm 21, and the upper housing 11 comprises a plastic body and has a metal sheet 110 provided at the central position of the upper housing 11 by injection molding. Compared with plastic material, metallic material may have the required strength in a thinner thickness. Thus, the structure with a metal sheet 110 injection-molded in the upper housing 11 may decrease the thickness of the speaker module or may increase the inner space of the speaker module in the case of that the thickness of the speaker module is defined, thereby increasing the size of the active sound source and improving the acoustic performance of the product. The middle housing 12 fixes the magnetic circuit system, the upper housing 11 and the middle housing 12 are fixedly bonded by adhering or ultrasonic welding, and the upper housing 11 and the middle housing 12 accommodate and fix the active sound source.

The inner space of the speaker module is divided into a front acoustic cavity and a rear acoustic cavity by the vibrating diaphragm 21. The front acoustic cavity is a space formed between the upper side of the vibrating diaphragm 21 and the protective frame. The front acoustic cavity is in communication with the sound hole 10 for the active sound source to radiate sound to outside. However, the present invention is not limited to this structure, and alternative, the rear acoustic cavity may be in communication with the sound hole 10. The rear acoustic cavity is an acoustic cavity formed at one side of the vibrating diaphragm 21 closer to the magnetic circuit system. A passive sound source is provided in the rear acoustic cavity provided by the present invention, while the conventional rear acoustic cavity is enclosed.

Figure 3:
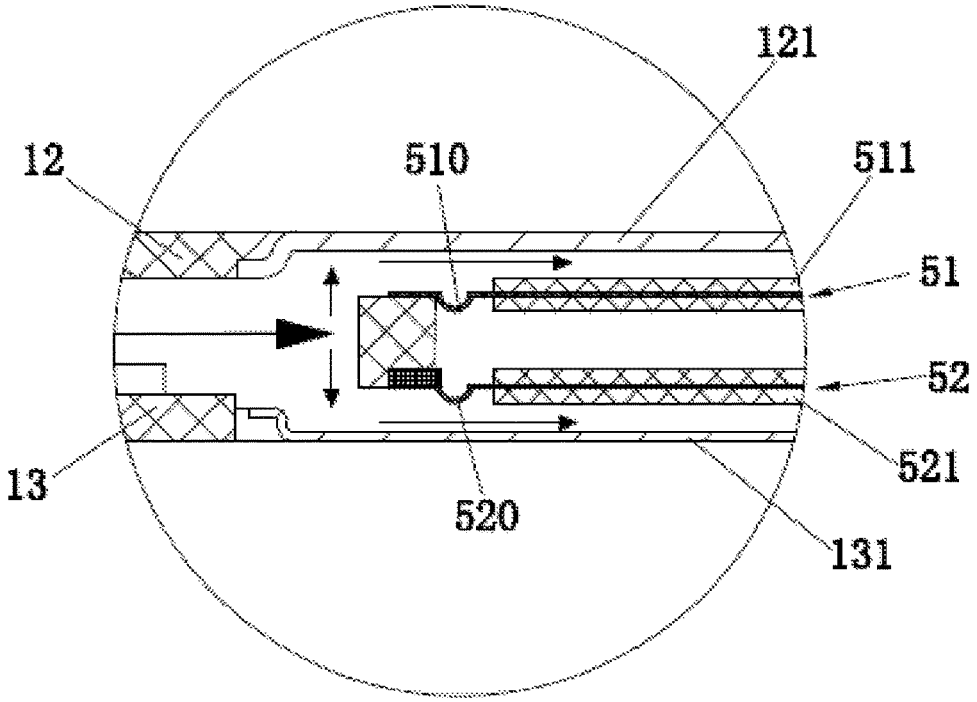
FIG. 3 is an enlarged structure diagram of part A of the speaker module shown in FIG. 1.

As shown in FIG. 1 and FIG. 3, two passive radiators may be provided in the rear acoustic cavity of the speaker module provided by the present invention, i.e., a passive radiator 51 and a passive radiator 52. The passive radiator 51 and the passive radiator 52 are provided in parallel and opposite to each other, and a cavity is formed between the passive radiator 51 and the passive radiator 52.

It should be noted that, in the present embodiment, the passive radiator 51 and the passive radiator 52 have the same structure, but are not limited thereto.

When the sound wave generated at the back side of the vibrating diaphragm 21 (i.e., one side closer to the magnetic circuit system) in the active sound source spreads to the passive sound source, the sound wave spreads to the sides of the passive radiator 51 and the passive radiator 52 away from each other (i.e., the sides away from the cavity), i.e., the air flow is divided into two parts, which flow to the upper side of the passive radiator 51 and the lower side of the passive radiator 52 respectively, which enables the air in the cavity between the two passive radiators to be pressed to pass through the sound holes for the passive sound source to the outside. The structure with passive radiators provided in the rear acoustic cavity may fully use the space in the rear acoustic cavity. By using the sound wave in the rear acoustic cavity to vibrate the passive radiators to generate sound, and generate bass sound, the bass effect of the whole speaker module is improved.

Wherein, each of the passive radiator 51 and the passive radiator 52 comprises a vibrating diaphragm body part and mass blocks bonded to the vibrating diaphragm body part, the vibrating diaphragm body part is made from flexible material, and the mass blocks usually are made from relatively heavy metallic material. As shown in FIG. 3, specifically, the passive radiator 51 comprises a vibrating diaphragm body part 510 and mass blocks 511, and the passive radiator 52 comprises a vibrating diaphragm body part 520 and mass blocks 521. Wherein, the vibrating diaphragm body part 510 and the vibrating diaphragm body part 520 are made from TPU (thermoplastic polyurethane) which has relatively good damping effect. The mass blocks bonded to the vibrating diaphragm body part may increase the weight of the passive radiators so as to enhance the heavy bass effect. As the inner space of the speaker module is relatively small, the mass block 511 and the mass block 521 are preferably made from tungsten steel alloy with a higher density, so that the desired weight of the passive radiators may be achieved by thinner mass blocks. Preferably, the same mass blocks are bonded at the upper and lower sides of the vibrating diaphragm body part respectively, that is, one mass block 511 is bonded at each of the upper and lower sides of the vibrating diaphragm body part 510, and one mass block 521 is bonded at each of the upper and lower sides of the vibrating diaphragm body part 520. With such a structure, the passive radiators may vibrate evenly while the weight of the passive radiators is ensured. Wherein, the vibrating diaphragm body part comprises a flat dome portion located at the central position thereof and a suspension ring portion with a certain cambered surface at the edge thereof. In the present embodiment, the suspension ring portions of the passive radiator 51 and the passive radiator 52 bend in the same direction, which may ensure the consistency between the two passive radiators, but the present invention is not limited to such a structure.

As shown in FIG. 1, the rear acoustic cavity of the speaker module is mainly formed by the middle housing 12 and the lower housing 13. As shown in FIG. 1 and FIG. 3, both the passive radiator 51 and the passive radiator 52 are bonded to the boss of the middle housing 12, an independent inner cavity is formed by the middle housing 12, the passive radiator 51 and the passive radiator 52, and the inner cavity is in communication with the sound holes for the passive sound source only via two acoustic guide channels, thereby achieving communication with the outside. Likewise, in order to fully use the space in the speaker module, a metal sheet 121 is injection-molded at a position on the middle housing 12 which position facing the passive radiator 51, and similarly, a metal sheet 131 is injection-molded at a position on the lower housing 13 which position facing the passive radiator 52. With the structure of injection-molding metal sheets at the positions where the vibration amplitude of the passive radiators 51 and 52 is larger, the height (space) at said positions may be increased so as to provide sufficient space for the two passive radiators to vibrate, thereby ensuring the acoustic performance of the speaker module.

Figure 4:
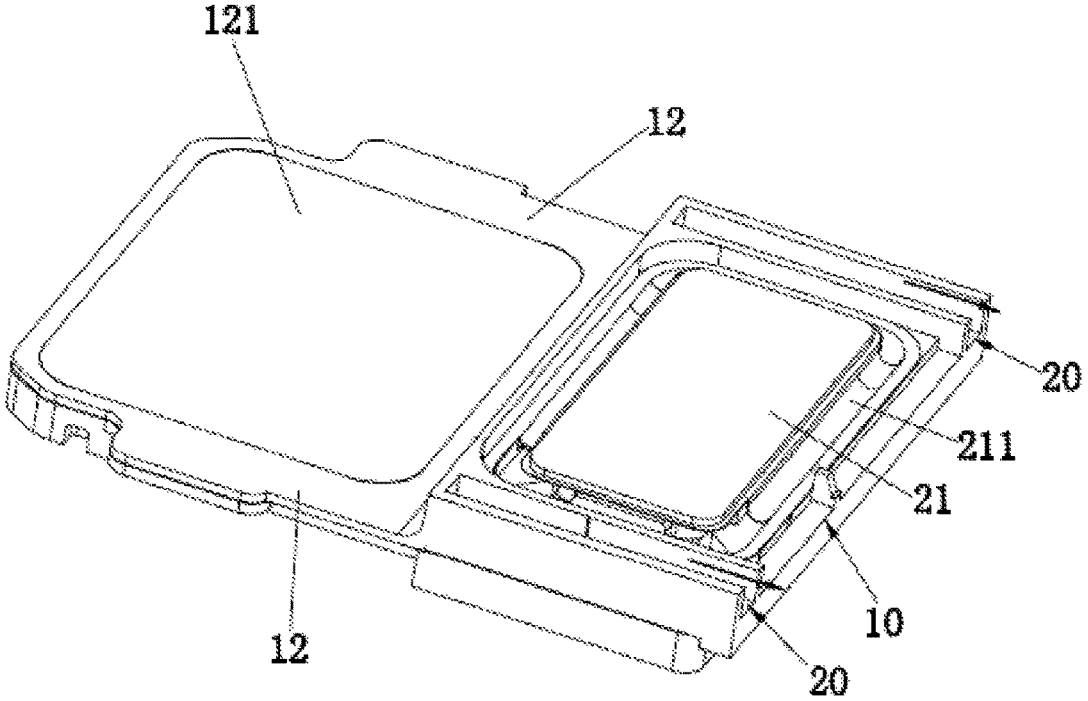
FIG. 4 is a three-dimensional structure diagram showing the speaker module with the upper housing removed according to the present invention.
Figure 5:
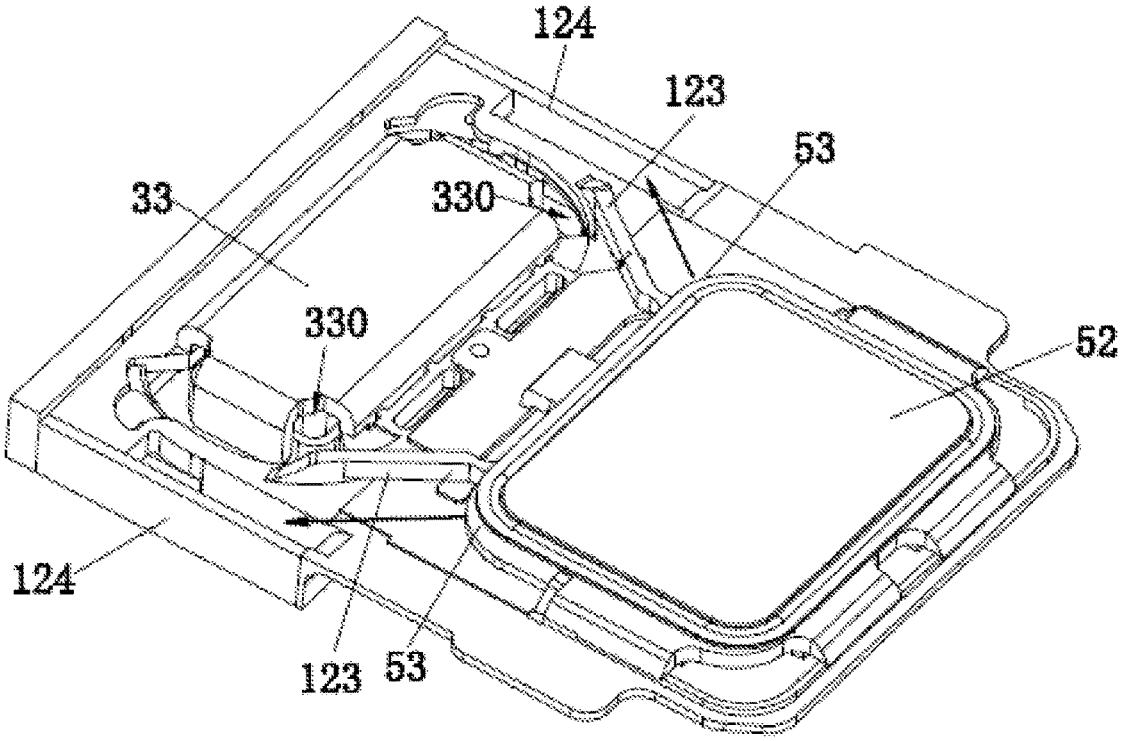
FIG. 5 is a three-dimensional structure diagram showing the speaker module with the lower housing removed according to the present invention.

As jointly illustrated by FIG. 4 and FIG. 5, FIG. 4 is a three-dimensional structure diagram showing the speaker module with the upper housing 11 removed, and FIG. 5 is a three-dimensional structure diagram showing the speaker module with the lower housing 13 removed. As shown in FIG. 4, the sound holes 20 for the passive sound source are formed between the middle housing 12 and the upper housing 11 of the speaker module. In order to clearly illustrate configuration and position of the sound holes 20 for the passive sound source, the upper housing 11 is not shown. The sound holes 20 for the passive sound source are located at both sides of the sound hole 10 for the active sound source, and are formed in a separate structure independent of the sound hole 10 for the active sound source. The two sound holes 10 for the passive sound source are independent structures respectively, and the sound wave generated by the passive radiators are divided into two parts which are radiated to outside from the two sound holes 20 for the passive sound source.

Preferably, the sound hole 10 for the active sound source and the sound holes 20 for the passive sound source are located at the same lateral surface of the protective frame, so as to facilitate assembly with terminal products. As jointly shown in FIG. 5, the air flow between the passive radiator 51 (not shown in FIG. 5) and the passive radiator 52 is radiated through the apertures 53, and enters into the acoustic guide channels formed by bonding the middle housing 12 and the lower housing 13. The transmission path is illustrated by arrows in FIG. 5, and the air flow is radiated to outside from the sound holes 20 for the passive sound source through the acoustic guide channels. As shown in FIG. 5, the projected bonding rib 123 is provided on the middle housing 12, and the bonding rib 123 and the lower housing 13 may be fixed and bonded together by way of ultrasonic welding or adhering, so as to form the acoustic guide channels for sound wave of the passive radiators.

Four openings 330 are provided at four corners of the yoke 33 of the active sound source, as shown in FIG. 5, and the openings 330 enable sound wave at the back side of the vibrating diaphragm 21 to be transmitted to the rear acoustic cavity via the openings 330, and then to two sides of the two passive radiators. As shown jointly in FIG. 5, the sound wave transmitted from the openings 330 and the sound wave transmitted from the apertures 53 are separated by the bonding rib 123, that is, two sound waves are separated by the middle housing 12 and the lower housing 13 to be transmitted in different transmission paths. In addition, on the outer lateral walls of the acoustic guide channels, steel sheets are injection-molded at the positions facing the active sound source. As shown in FIG. 5, steel sheets 124 are injection-molded at the positions at the outer side of the lateral wall of the middle housing 12 facing the active sound source. Providing the steel sheets 124 at the positions is aimed at utilizing the feature of high strength of the steel sheets, so as to increase the inner diameter of the acoustic guide channels, thereby facilitating radiation of passive sound wave, and improving acoustic performance.

As shown in FIG. 1 to FIG. 5, the speaker module of the present invention comprises an active sound source and a passive sound source, the sound radiated by the vibrating diaphragm 21 of the active sound source is radiated to outside through the sound hole 10 for the active sound source, this part of sound wave is mainly the sound wave in the middle and high frequency band. The passive sound source comprises two passive radiators, i.e., the passive radiator 51 and the passive radiator 52, the two passive radiators are driven by sound wave at the back side of the vibrating diaphragm 21 respectively, so that the air flow in the cavity between the two passive radiators is pressed and radiated to outside so as to form low-frequency sound wave. Particularly, the sound wave at one side of the vibrating diaphragm 21 of the active sound source closer to the rear acoustic cavity is output to the position where the passive radiators are located through the openings 330 at the corners of the yoke 33, and then the sound wave is divided into two parts which are transmitted to the upper and lower sides of the two passive radiators respectively. The air flow between the two passive radiators is pressed, and enters into the acoustic guide channels formed by the middle housing 12 and the lower housing 13 through the apertures 53. The sound wave of the passive sound source is in communication with outside via the sound holes 20 for the passive sound source at the other end of the acoustic guide channels, so that the low-frequency sound wave is radiated to outside.

In the speaker module provided by the present invention, the passive sound source is provided in the rear acoustic cavity, and the passive sound source comprises two passive radiators arranged in parallel, and the low-frequency sound wave may be generated by pressing the air flow in the cavity between the two passive radiators. Such a structure may fully use the inner space of the speaker module, improve its mega bass effect, and improve the acoustic performance of the module in the case of that the size of the speaker module is smaller.

As described above, the speaker module provided by the present invention is described by way of example with reference to the accompanying drawings. However, it should be understood by those skilled in the art that as for the speaker module provided by the present disclosure above, other improvements and variants, which fall into the scope of the present disclosure, can be made without departing from the essence of the present disclosure. It will be understood by those skilled in the art that the above specific description aims at better understanding of the present disclosure, the scope of the present disclosure is defined by the claims and its equivalents.

The invention claimed is:

1. A speaker module, comprising an active sound source, a passive sound source, and a protective frame for accommodating and fixing the active sound source and the passive sound source, wherein the active sound source comprises a vibration system and a magnetic circuit system, the vibration system comprises a vibrating diaphragm and a voice coil, and the magnetic circuit system is formed with a magnetic gap for accommodating the voice coil; a front acoustic cavity is formed between an upper side of the vibrating diaphragm and the protective frame, and a rear acoustic cavity is formed between a side of the vibrating diaphragm closer to the magnetic circuit system and the protective frame, wherein:

the active sound source has a structure emitting sound at a lateral side, and a sound hole for the active sound source is provided at a lateral side of the protective frame, and the sound hole for the active sound source is in communication with the front acoustic cavity;

the passive sound source is provided in the rear acoustic cavity and comprises two passive radiators opposite to each other, and the two passive radiators are arranged in parallel, so that a cavity inside the rear acoustic cavity is formed between the two passive radiators, a first gap is formed between one of the two passive radiators and the protective frame, and a second gap is formed between another one of the two passive radiators and the protective frame, wherein the cavity is in communication with the outside through sound holes for the passive sound source; and a sound wave at the side of the vibrating diaphragm closer to the magnetic circuit system is divided into two parts by the passive sound source, and the two parts are transmitted into the first gap and the second gap, respectively, so that a sound wave in the cavity is pressed and radiated to outside through sound holes for the passive sound source.

2. The speaker module according to claim 1, wherein the sound hole for the active sound source and the sound holes for the passive sound source are isolated from each other, and are located at a same lateral side of the speaker module.

3. The speaker module according to claim 2, wherein the cavity between the two passive radiators is in communication with the sound holes for the passive sound source through acoustic guide channels, and the acoustic guide channels are formed by the protective frame.

4. The speaker module according to claim 3, wherein the protective frame comprises an upper housing, a middle housing and a lower housing, the active sound source is accommodated by the upper housing and the middle housing, and the passive sound source is accommodated by the middle housing and the lower housing;

metal sheets are injection-molded at a side of the upper housing facing the vibrating diaphragm, a side of the middle housing facing the passive radiators, and a side of the lower housing facing the passive radiators, respectively.

5. The speaker module according to claim 4, wherein the acoustic guide channels are formed by bonding the middle housing with the lower housing; a bonding rib is provided at a side of the middle housing facing the lower housing, and the acoustic guide channels are formed by bonding the bonding rib with the lower housing.

6. The speaker module according to claim 5, wherein a number of the sound holes for the passive sound source is two, and the two sound holes for the passive sound source are positioned at two sides of the sound hole for the active sound source, respectively;

apertures for communicating the cavity with the acoustic guide channels are provided at the middle housing, both a number of the apertures and a number of the acoustic guide channels are two, and the two apertures and the two acoustic guide channels are in communication with the two sound holes for the passive sound source, respectively.

7. The speaker module according to claim 5, wherein steel sheets are injection-molded at portions of outer lateral walls of the acoustic guide channels facing the active sound source, a number of the steel sheets is two, and the two steel sheets and two outer lateral walls of the middle housing are integrally injection-molded, respectively.

8. The speaker module according to claim 1, wherein the two passive radiators have an identical structure, and each of the two passive radiators comprises a vibrating diaphragm body part and mass blocks bonded to the vibrating diaphragm body part;

the vibrating diaphragm body part is made of thermoplastic polyurethane material.

9. The speaker module according to claim 8, wherein the mass blocks are bonded at center positions of an upper side and a lower side of the vibrating diaphragm body part, and the mass blocks are made of tungsten steel alloy material.

10. The speaker module according to claim 1, wherein the vibrating diaphragm of the active sound source comprises a dome portion located at a central position thereof and a suspension ring portion located at an edge position thereof, the suspension ring portion has a concave structure recessed towards one side closer to the magnetic circuit system, and a position where the suspension ring portion is connected with the housing is lower than a position where the suspension ring portion is connected with the dome portion, so as to increase a height difference of the sound hole for the active sound source, thereby increasing an area for radiating sound.

* * * * *